US007793708B2

(12) United States Patent
Wanni et al.

(10) Patent No.: US 7,793,708 B2
(45) Date of Patent: Sep. 14, 2010

(54) ANTI-VIBRATION TUBE SUPPORT

(75) Inventors: Amar S. Wanni, Falls Church, VA (US); Marciano Madrid Calanog, Gainesville, VA (US); Thomas M. Rudy, Warrenton, VA (US); Malcolm D. Keen, Fairfax Station, VA (US)

(73) Assignee: ExxonMobil Research & Engineering Company, Annandale, NJ (US)

( * ) Notice: Subject to any disclaimer, the term of this patent is extended or adjusted under 35 U.S.C. 154(b) by 905 days.

(21) Appl. No.: 11/128,884

(22) Filed: May 13, 2005

(65) Prior Publication Data

US 2005/0279487 A1 Dec. 22, 2005

Related U.S. Application Data

(60) Provisional application No. 60/580,984, filed on Jun. 18, 2004.

(51) Int. Cl.
*F28F 9/013* (2006.01)

(52) U.S. Cl. ..... 165/69; 165/162; 122/510

(58) Field of Classification Search ..... 165/162, 165/158, 172, 178, 160; 248/68.1; 122/32; 376/405

See application file for complete search history.

(56) References Cited

U.S. PATENT DOCUMENTS 3,199,582 A * 8/1965 Vogt et al. ..... 165/69
3,439,737 A * 4/1969 Betts et al. ..... 165/109.1
3,626,481 A * 12/1971 Taylor et al. ..... 165/162
3,637,008 A * 1/1972 Michel et al. ..... 165/69
3,646,994 A * 3/1972 Piepers et al. ..... 165/69
3,924,676 A * 12/1975 Bennett ..... 165/172
3,933,583 A 1/1976 Jabsen
3,989,105 A * 11/1976 Trepaud ..... 165/158
4,160,477 A * 7/1979 Roffler ..... 165/172

(Continued)

FOREIGN PATENT DOCUMENTS

EP 0 646 760 A1 4/1995

(Continued)

OTHER PUBLICATIONS

European Search Report for EP 05 076348, dated Aug. 22, 2005.

*Primary Examiner*—Allen J Flanigan

(57) ABSTRACT

A tube support device is used with tube bundle devices such as heat exchangers or, condensers with in-line tube arrangements (rectangular tube configuration) to mitigate the possibility of tube damage from flow-induced vibration in the tube bundle. The tube support comprises an elongated member or strip which is intended to be inserted in a tube lane between the tubes of the tube bundle. Raised-tube-engaging zones which include transverse, arcuate tube-receiving saddles are disposed along the length of the strip at successive longitudinal locations corresponding to the tube positions in the bundle. These tube-engaging zones extend laterally out, away from the medial plane of the strip, so that the saddles receive and closely hold the tubes on opposite sides of the tube lane. The support device may be made of two strips joined back-to-back with the tube-engaging zones extending out from one face of each strip or, alternatively, by a single strip with longitudinal slits which enable the tube-engaging zones to extend out on alternate faces of the strip at each tube location.

3 Claims, 3 Drawing Sheets

U.S. PATENT DOCUMENTS

| | | | | | |
|---|---|---|---|---|---|
| 4,175,003 | A | | 11/1979 | Beuchel et al. | |
| 4,204,570 | A | * | 5/1980 | Eisinger | 165/69 |
| 4,286,654 | A | * | 9/1981 | Ruhe et al. | 165/172 |
| 4,344,480 | A | * | 8/1982 | Boyer et al. | 165/162 |
| 4,359,088 | A | | 11/1982 | Jabsen | |
| 4,433,721 | A | * | 2/1984 | Biaggi | 165/162 |
| 4,594,216 | A | * | 6/1986 | Feutrel | 376/442 |
| 4,648,442 | A | | 3/1987 | Williams | |
| 4,665,866 | A | * | 5/1987 | Wepfer | 122/510 |
| 4,781,884 | A | | 11/1988 | Anthony | |
| 4,860,697 | A | | 8/1989 | Malaval | |
| 4,919,199 | A | | 4/1990 | Hahn | |
| 5,072,786 | A | | 12/1991 | Wachter | |
| 5,213,155 | A | | 5/1993 | Hahn | |
| 5,243,635 | A | * | 9/1993 | Bryan | 376/442 |
| 5,570,739 | A | * | 11/1996 | Krawchuk et al. | 165/69 |
| 5,692,557 | A | | 12/1997 | Gillet et al. | |
| 6,401,803 | B1 | | 6/2002 | Hahn | |
| 7,032,655 | B2 | * | 4/2006 | Wanni et al. | 165/162 |

FOREIGN PATENT DOCUMENTS

| | | | |
|---|---|---|---|
| EP | 1 491 841 | A1 | 12/2004 |
| FR | 2 652 639 | A1 | 4/1991 |
| JP | 61059196 | A1 | 3/1986 |
| JP | 2002195778 | A1 | 7/2002 |

* cited by examiner

Section X-X

ANTI-VIBRATION TUBE SUPPORT

This application claims the benefit of U.S. Ser. No. 60/580,984 filed Jun. 18, 2004.

CROSS REFERENCE TO RELATED APPLICATIONS

Application Ser. No. 10/848,903 filed 19 May 2003, Publication No. 20050006075A1, entitled "Anti-Vibration Tube Support" of A. S. Wanni, M. M. Calanog, T. M. Rudy, and R. C. Tomotaki relates to a different type of anti-vibration tube support.

FIELD OF THE INVENTION

This invention relates to tube support devices, commonly referred to as tube stakes which are useful with tube bundles in heat exchangers and similar fluid-handling equipment.

BACKGROUND OF THE INVENTION

Tube bundle equipment such as shell and tube heat exchangers and similar items of fluid handling devices utilize tubes organized in bundles to conduct the fluids through the equipment. In such tube bundles, there is typically fluid flow both through the insides of the tubes and across the outsides of the tubes. The configuration of the tubes in the bundle is set by the tubesheets into which the tubes are set. One common configuration for the tubes is the rectangular formation with the tubes set in aligned rows with tube lanes (the straight paths between the tubes) between each pair or rows, aligned orthogonally to one another. In this formation, each tube is adjacent to eight other tubes except at the periphery of the tube bundle and is directly opposite a corresponding tube across the tube lane separating its row from the two adjacent rows. In the triangular tube formation, the tubes in alternate rows are aligned with one another so that each tube is adjacent to six other tubes (the two adjacent tubes in the same row and four tubes in the two adjacent rows).

Fluid flow patterns around the tubes as well as the changes in the temperature and density of the fluids which arise as they circulate and result in heat exchange between the two fluids flowing in and around the tubes may give rise to flow-induced vibrations of an organized or random oscillatory nature in the tube bundle. If these vibrations reach certain critical amplitudes, damage to the bundle may result. Tube vibration problems may be exacerbated if heat exchange equipment is retubed with tubes of a different material to the original tubes, for example, if relatively stiff materials are replaced with lighter weight tubes. Flow-induced vibration may also occur when equipment is put to more severe operating demands, for example, when other existing equipment is upgraded and a previously satisfactory heat exchanger, under new conditions, becomes subject to flow-induced vibrations. Vibration may even be encountered under certain conditions when an exchanger is still in the flow stream but without heat transfer taking place.

Besides good equipment design, other measures may be taken to reduce tube vibration. Tube support devices or tube stakes as these support devices are commonly known (and referred to in this specification) may be installed in the tube bundle in order to control flow-induced vibration and to prevent excessive movement of the tubes. A number of tube supports or tube stakes have been proposed and are commercially available. One type, described in U.S. Pat. No. 4,648,442 (Williams) has a U-shaped configuration in which the distance between the top and bottom surfaces of the channel is the same as the distance between adjacent rows in the tube bundle (i.e., is substantially the same as the tube lane dimension). This type of stake is inserted between the rows in the bundle and is secured at the end by an arcuate segment which engages a segment of a tube at the periphery of the tube bundle so as to lock the stake in place in its appropriate position between the rows in the bundle. Stakes of this type are typically made of a corrosion-resistant metal, for example, type 304 stainless steel with a thickness between 0.7 and 1.2 mm to provide both the necessary rigidity for the staked tube bundle as well as sufficient resilience in the U-shaped channel to allow the stakes to be inserted into the lanes between the tubes in the bundle.

Another form of anti-vibration tube stake is described in U.S. Pat. No. 4,919,199 (Hahn) which discloses a stake made in a soft V-configuration strip in which saddles are formed perpendicular to the longitudinal axis of the strip in the open ends of these V-shaped cross sections. The saddles are formed in the strip with a pitch (distance between saddles) equal to the tube pitch and with a radius which matches that of the tubes in the tube bundle so the saddles engage with the tubes on one side of the tube lane. The engagement between these tubes and the saddles locks the tube into place in the tube bundle. The resilient nature of the strip, coupled with the spring type action provided by the V-configuration, permits the arms of the V to open and reduce the effective overall width of the stake and enables the stake to engage the tubes on both sides of a tube lane so that the V-shaped stake is locked into place between the two rows of tubes.

A similar type of tube stake is described in U.S. Pat. No. 5,213,155 (Hahn) which discloses a U-shaped stake which is inserted between two tube lanes with the closed end of the U over one of the peripheral tubes in the bundle. Saddles are formed in the open ends of the V-shaped cross section to engage with opposite sides of the tubes in a single row in the bundle. The U-shaped stake is fastened in place around the tubes of the bundle by suitable fasteners extending between the two arms of the stake.

One problem with the pressed configuration of the type shown in U.S. Pat. No. 4,648,442 is that the stakes do not create a positive location for each individual tube, although the stake is locked into place in its selected tube lane. The tubes remain free to vibrate in one plane parallel to the tube lane and parallel to the stake. A different problem exists with the design shown in U.S. Pat. No. 5,213,155: although the tubes in rows encircled by the U-shaped stakes are fully supported, the tubes at the periphery of the tube bundle which are not directly encircled by one of the stakes i.e., retained within one of the closed ends of the U-shaped stakes (these are the outer tubes in alternate rows which are not encircled by the ends of the U-shaped stakes), are free to move and vibration in these tubes can be expected under certain conditions. In addition, because the corrugation of the tube support has a transition region before reaching its full depth, the two tubes adjacent to each of the outermost tubes do not receive any vibration mitigation either.

One disadvantage of the stake designs which use channel pressings to accommodate the distance between the tubes forming a single tube lane is that deep channel pressings are required or other measures necessary when the tube lane is relatively wide. A more complicated form of tube support is shown in U.S. Pat. No. 6,401,803 (Hahn). This stake uses two V-shaped pressings separated by compression springs which force the stakes against the tubes on opposite sides of the tube lane in order to dampen oscillatory vibrations. This form of stake is, however, quite expensive to manufacture. A unitary stake which will accommodate relatively wide tube lanes without the complication of separate parts therefore remains desirable.

SUMMARY OF THE INVENTION

According to the present invention, a tube support or tube stake is used with in-line tube arrangements (rectangular tube configurations) to mitigate the possibility of tube damage from flow-induced vibration in the tube bundle of the heat exchanger, condenser or other collection of tubes, for example, in devices such as nuclear reactors, electrical heaters, or any collection of parallel cylindrical shapes that has a fluid flow passing over them. The tube support comprises a flat, elongated member or strip which is intended to be inserted in a tube lane between the tubes of the tube bundle. Raised-tube-engaging zones which include transverse, arcuate tube-receiving saddles are disposed along the length of the strip at successive longitudinal locations corresponding to the tube positions in the bundle. These tube-engaging zones extend laterally out from each face of the member opposite one another at each location; they extend away from the medial plane of the member, so that the saddles receive and closely hold the tubes on opposite sides of the tube lane.

The tube supports may be formed by joining two strips in back-to-back fashion each having the tube-engaging zones pressed out on one face of the strip. In this form, a flat strip is formed with the tube-engaging zones extending out on only one face of the strip and two of these strips are then united in back-to-back fashion to form the support with the tube-engaging zones on the opposed faces of the strip. An alternative construction uses a flat strip which is slitted at each tube location to provide adjacent transverse regions across the strip which are formed into raised tube-engaging zones on opposed faces of the strip. The tube-engaging zones at a given transverse position extend in an alternate fashion from the two opposite faces of the strip relative to the zones in the same transverse position at each successive longitudinal location. In either form, the support can be seen as having flat (planar) sections uniting the sections with the tube-engaging zones while the tube-engaging zones, including the saddles, can be seen as being formed with only one plane of curvature (i.e., the strip is curved solely in the longitudinal direction and not in the transverse direction; in the transverse direction, the strip is flat at all points across the width of the strip). It is this feature which enables the support to be readily fabricated in very simple pressing operations with simple press forms or dies.

The tube supports are intended for use in the conventional rectangular (in-line) tube formations. The supports may be inserted into each tube lane or into alternate tube lanes. When inserted into each tube lane, as is preferred, the tubes receive support from supports on both sides with consequent improved support.

The tube supports may be conveniently and inexpensively fabricated by pressing with simple die forms equipped with suitably arranged protrusions and cavities to form the saddles or by the use of pairs of rollers which have protrusions and cavities (alternating between the top and bottom rollers of the set) to form the raised zones on the strip. Many of the known types of tube support do not lend themselves to this simple, economical and convenient method of fabrication.

DRAWINGS

DETAILED DESCRIPTION

The tube support or tube stake of the present invention is arranged to provide direct support for tubes which are adjacent to one another but on opposite sides of a tube lane. The tube support may be inserted between the tubes in the tube bundle along a tube lane between adjacent tube rows. Where the construction of the exchanger permits, the support may be made sufficiently long to extend from one side of the tube bundle to the other to provide support for the tubes across the entire width of the bundle; in this case, the length of the tube supports will vary according to the length of the tube lanes across the bundle. In many cases, however, the location of pass lanes in the bundle will create discontinuities in the lanes so that it will not be possible to insert the supports all the way across the bundle. In such cases, it may be possible to insert the supports into the bundle from different sides of the bundle at different locations along the length of the bundle so as to provide as much support as possible for the tubes. Thus, the supports may be inserted vertically at one or more locations and horizontally at other locations along the length of the bundle. In view of their simple and repetitive configuration, the present tube supports may be readily cut to the desired length to fit the bundle, whether extending entirely across it or only part of the way. The tube supports or tube stakes can be utilized to provide vibration mitigation in addition to the baffles in standard shell-and-tube-type heat exchangers or as the only support mechanism in axial flow bundles. When the supports are used in addition to standard baffles, a girdle band connecting the outer edge of all the supports at any axial location may be provided and this may be as simple as a cable passing through a hole in the end of each support strip. When the supports are used as the only support in an axial flow bundle, a more rigid girdle with firm attachment to the supports is preferably used, as described below, along with a separate baffle construction to direct the liquid flow appropriately.

Figure 1:
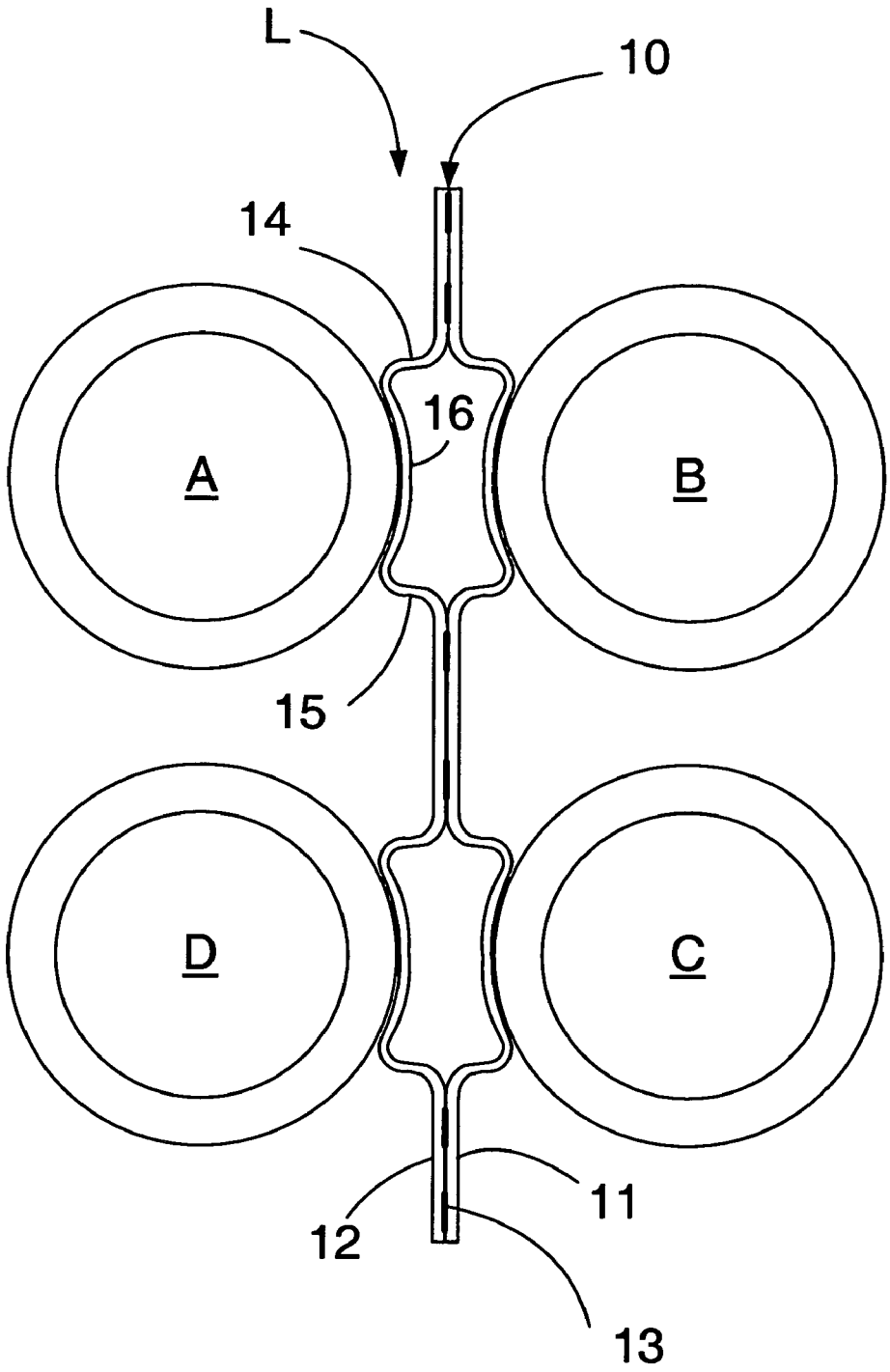
FIG. 1 is a cross-section of four tubes in a rectangular arrangement heat exchanger with a tube support according to the present invention supporting the tubes.

FIG. 1 shows four adjacent tubes A, B, C, D, in a tube bundle with a rectangular tube formation. A tube support 10 is inserted into the tube lane L between two rows of tubes. Tube support 10 extends in tube lane L defined by tubes A and D on one side of the lane and tubes B and C on the other side of the tube lane. Of course, in the complete tube bundle, there will be additional tubes extending in the row formed by a continuation of the tube row containing tubes A and D and another row continuing on from tubes B and C with other tube rows arranged in similar conventional manner making up the tube bundle. The tube lanes between these two adjacent rows and other adjacent rows of tubes will be similarly extensive across the tube bundle unless interrupted by pass lanes.

Tube support 10 comprises an elongated flat member made up of two flat strips of metal 11, 12 welded together back-to-back by resistance welds. One weld is indicated at 11 and other welds are regularly spaced at other locations along the length of the support. Alternative methods of attachment between the two strips may, of course, be used, for example, rivets or screws although these will, in general, not be as economical or reliable as resistance or spot welding. The tube-engaging zones are created on each face of support 10 by forming the two strips 11, 12 to provide the transverse, arcuate tube-receiving saddles at successive locations along the member corresponding to the positions of the tubes. The tube-engaging zones each comprise (as indicated with respect to tube A) a pair of lateral extensions 14, 15 which extend laterally outwards away from the medial plane of the support member in opposite directions towards the adjacent tubes at that location. The ends of the lateral extensions are joined together by means of a transverse, arcuate tube-receiving saddle 16 which has a curvature corresponding or approximating to the diameter of the tube so that the tube is nested closely in the saddle and held in place. A corresponding tube-engaging zone is formed on the other face of the member, extending laterally outwards, away from the medial plane of the member in the direction of tube B, with a corresponding transverse tube-receiving saddle to hold tube B. Similar tube-engaging zones are provided for tubes C and D and so on along the length of the support at successive locations along the length of the member.

Figure 2:
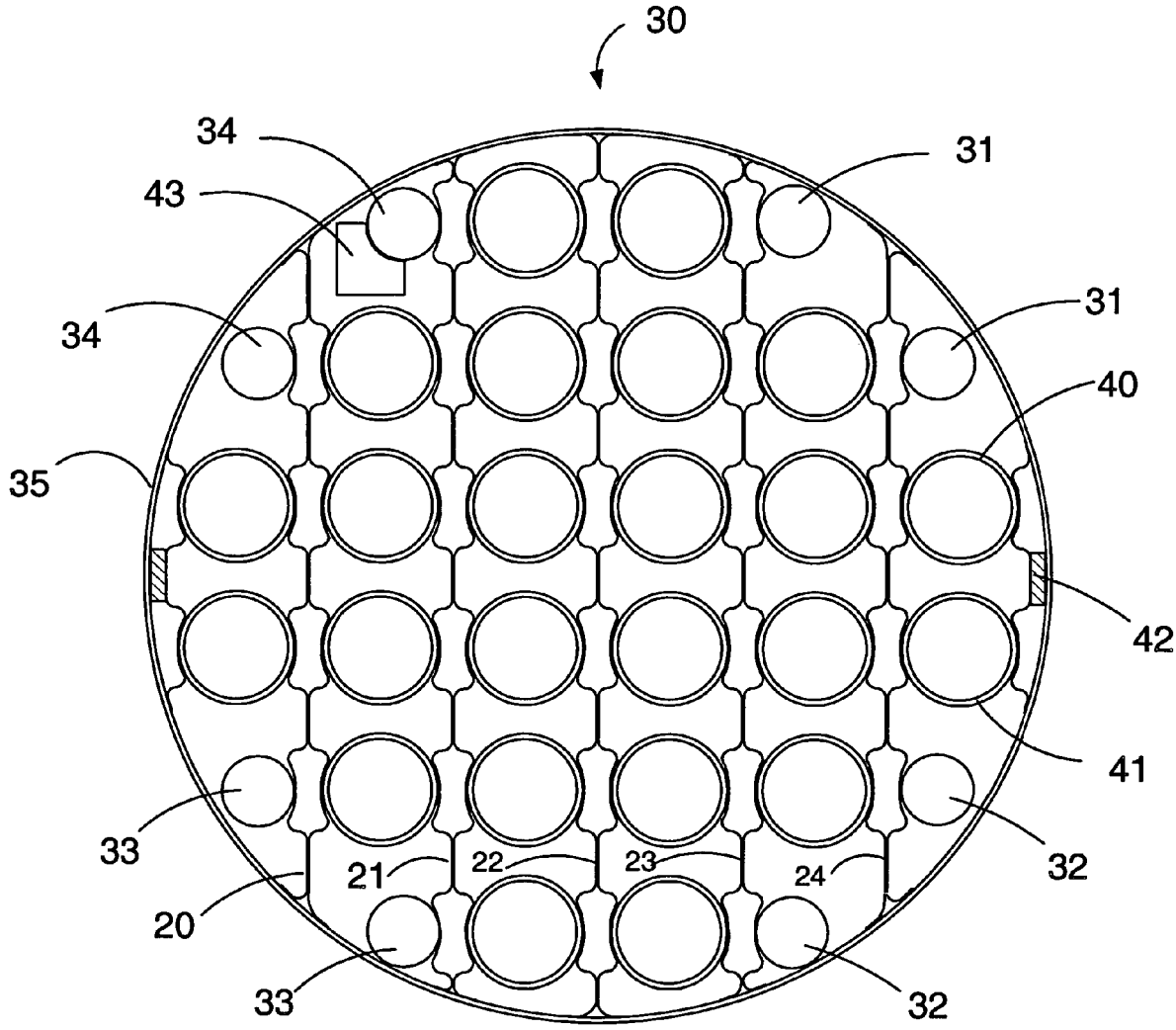
FIG. 2 is a cross-section of a tube bundle of rectangular configuration with tube supports inserted into the bundle.

The tube supports are preferably inserted into the tube bundle so that the tubes receive support on both sides from supports inserted into each tube lane. FIG. 2 shows a cross-section of a rectangular tube bundle with the supports inserted in this way. Tube supports 20, 21, 22, 23, 24 are inserted into the tube lanes formed between the tube rows in the bundle, one of which is designated 30. The arcuate tube-receiving saddles on each support receive and cradle the tubes, provide support and reduce their propensity to vibration while imposing only a minimal restriction of flow parallel to the tubes. Tie rods 31, 32, 33, 34 for the tube bundle are provided in conventional manner and extend essentially from one tube sheet to the other in the exchanger; to allow for differential thermal expansion between the tie rods and the tubes, the tie bars are firmly attached to only one tubesheet and are received in the opposite tube sheet by a sliding expansion joint. The tie rods also act as sealing devices by reducing flow bypassing. At each end, the tube supports are attached to girdle band 35 in the form of a flat strip which is formed into shape to encircle the bundle. Again, the supports may be attached by welding, riveting, by means of screws or any other method which is appropriate and convenient. Attachment may suitably be made by means of lateral extensions of the strip formed by bending the ends of the two strips over and outwards, away from one another to form lugs which can then be attached to the circular girdle band. The tubes at the side of the bundle (indicated on right hand side only, 40, 41) may be supported on the outside by short, one-sided supports, which are made up of one of the two strips of the main supports, to provide similar arcuate tube-receiving saddles. A metal strip 42 may be used to provide sufficient rigidity to the one-sided support by bracing it against the girth band 35. Sealing strips 43 may be provided at the outer corners of the bundle (one indicated) to further reduce flow bypassing. If by-passing is a problem, baffles may be provided in the form of pierced plates through which the tubes pass and in this case, the sealing strips may be formed integrally during the shaping of the plate. The use of pierced plates may be favorable in that the plate, being firmly located by means of tie rods passing through it and secured to it e.g. by means of welds, nuts or other locating devices, will provide additional locational support for the tubes. The apertures in the plates may be shaped so as to direct the flow around the tubes in the desired manner and to provide, in conjunction with the integral sealing strips at the edges of the plate, improved flow along the tube bundle. Pierced plates may suitably be formed from plate blanks by water-jetting using a suitable abrasive.

Figure 3B:
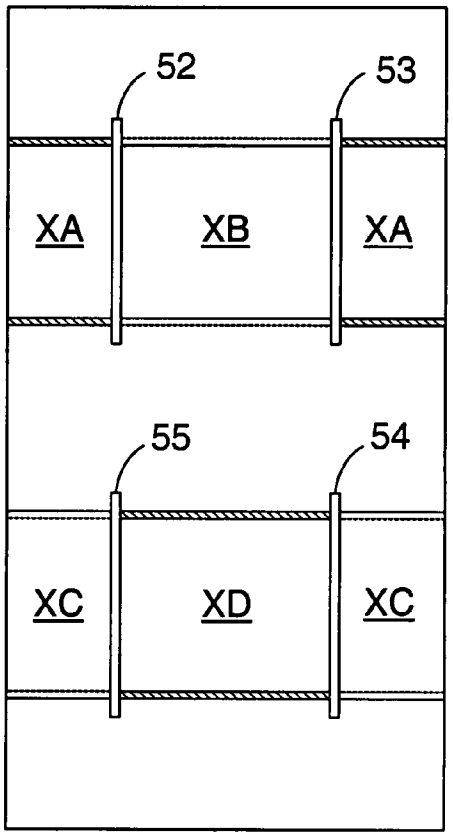
FIG. 3B is a section along X-X of FIG. 3A.
Figure 3A:
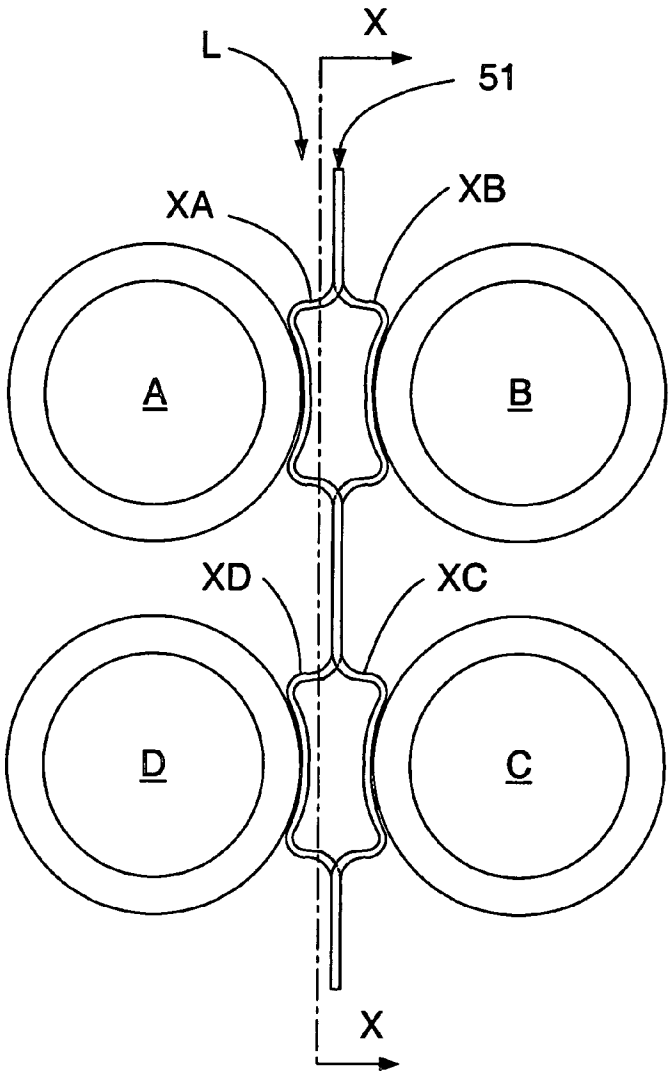
FIG. 3A is a cross-section of four tubes in a rectangular arrangement heat exchanger with a modified form of tube support according to the present invention.

As an alternative to the fabrication of the support from two flat strips of metal, as described above, the support may be fabricated in the form shown in FIGS. 3A and 3B from a single flat strip which is slitted longitudinally in the regions where the tube-engaging zones are to be formed and which is pressed out in the slitted region from the opposite faces of the strip in an alternating manner to form the tube-engaging zones. The strip 51 disposed in tube lane L of the rectangular tube arrangement has longitudinal slits 52, 53, 54, 55 in the regions where the tube-engaging zones are to be formed, corresponding to the tube positions. The tube-engaging zones are formed by deforming the slitted strip outwards in opposite directions from each face of the originally flat strip on each side of the slits to form the tube-engaging zones. Arcuate tube-receiving saddles XA, XB, XC, XD are formed as before to receive the tubes. It is desirable for the slits to have rounded ends and to be well finished in order to reduce the possibilities of stress-induced crack propagation both during the forming operation and in subsequent use, particularly since the support may be exposed to a tendency towards flow-induced vibration at operational conditions. If desired, the slits may be terminated with circular "keyhole" type stress-reliefs. In this construction, the saddles are not directly opposed to one another, being laterally displaced but at each longitudinal location, tube-engaging zones are opposed to accommodate the forces arising from insertion of the members between the tubes in the tube bundle.

The tube-engaging zones are formed in an alternating, complementary fashion with the saddles to provide support for the tubes. The first pair of opposed tube-engaging zones XA and XB, which provide support for tubes A and B are formed with two tube-engaging zones XA extending from one face of the strip to support tube A and one central zone XB interposed between the two side zones XA, extending from the opposite face of the strip to support tube B. At the next adjacent longitudinal location along the strip, the zones are formed similarly but at this location, the single, central tube-engaging zone XD is formed on the side of the strip which faces tube D (on the same side of the tube lane as tube A) with two side zones XC extending from the opposite face of the strip to support tube C. This alternating arrangement is repeated at successive longitudinal locations along the strip with the tube-engaging zones extending out alternately out from each face of the strip at each location and in the alternative manner at successive locations along the strip. For example, taking a case where the strip is slitted twice, the three tube-engaging zones at each longitudinal location can be formed as follows:

Row 1: UP–DOWN–UP

Row 1: DOWN–UP–DOWN,

Note: the designations "UP" and "DOWN" do not refer to true vertical directions but only to the relative directions from the medial plane and faces of the strip.

In this way, the forces acting on the strip at any single longitudinal location are balanced about the center line of the strip and the asymmetric arrangement at each location is compensated over the length of the strip so that the forces created by engagement of the strip with the tubes on both sides of the tube lane are in overall balance or substantially so as equal or approximately equal numbers of tube-engaging zones are formed on each face of the strip. Thus, a single strip of sufficient width can be formed into a tube support by slitting the strip longitudinally twice or more in the areas where the tube-engaging zones are to be formed to form three or more regions which can be extended laterally outwards to form the opposed tube-engaging zones.

The total depth (d) of the saddles (saddle peak to saddle valley) will be a compromise between the need for good tube support (which dictates a deep saddle) and the need for ready insertion into the bundle (which dictates a shallow saddle) and both will depend upon the diameter of the tubes and the tube spacing. Typically, the depth of the saddles will be from 1 to 5 mm, preferably 2 to 4 mm. The distance between the lowest points of the saddles at the point where tube engagement occurs should be about 0.25 to 2 mm greater than the tube spacing at this point in order to create a small deflection in the tubes to ensure reliable tube support. This larger value is needed especially if the strips are inserted into alternate tube lanes in an existing exchanger. If it is feasible to fabricate the tube support structure as seen in FIG. 2 prior to inserting the tubes; in this case, the interference should be smaller (closer to 0.25 mm). The elasticity of the support itself and the elasticity of the tubes, coupled with engagement between the saddles and the tubes will not only make the tubes more resistant to vibration but also retain the support in place in the bundle. One advantage of the present type of tube support is that relatively wide tube lanes can be accommodated without deep pressing of the strips since about half the tube lane dimension is taken up by each raised zone.

In addition to the total depth of the support, the thickness and stiffness of the metal of the strip will be factors in fixing the final tube deflection when the supports are inserted into the bundle. Normally, with the metals of choice, a strip thickness of from 1 to 2 mm for each of the two strips making up the support will be satisfactory to provide adequate tube support and ability to resist the stresses of insertion into the bundle. If a single slit strip is used, its thickness may be increased as necessary.

When the tube supports are inserted into the tube bundle, the raised tube-engaging zones have to be pushed past the tubes until the support is in its proper place in the bundle, with each tube accommodated within its corresponding saddle. Each tube-engaging zone has to be pushed through the gap between each pair of opposed tubes until the support is in place. Because the total depth of the tube engaging zones (peak-to-valley including plate thickness) is preferably slightly greater than the inter-tube spacing, the tubes have to bend slightly to let the saddles pass; although this maintains the support in place when it is in its final position, it makes insertion that much more difficult as the resistance to bending of each row of tubes has to be overcome. The lateral extensions 14, 15 which pass into the saddles may be given a greater slope so as to facilitate insertion: if this is done, the lateral extensions will provide ramps which will more readily part the tubes as the support is inserted into the bundle.

Each tube support engages with tubes on opposite sides of a tube lane so that insertion of a support in each tube lane provides support for two rows of tubes within the outer periphery of the tube bundle. At the periphery of the bundle some tubes may receive support from a support which does not support a tube on the other side. This reduces the effective support given to those tubes but since the length of support extending out from the last pair of tubes within the bundle is relatively short, some effective support is given to these outer tubes on one side at least by the cantilevered end of the support. Support may, however, be provided by tie roads and additional support strips as shown in FIG. 2.

While the frictional engagement between the supports and the tubes will provide for retention of the supports in the bundle, the tube supports are preferably fixed into place, either as shown in FIG. 2 by attachment to a girdle or by use of a tube-engaging crook which hooks over the end of a tube at the end of the tube lane to prevent withdrawal of the support in one direction.

The tube supports are suitably made of a metal which will resist corrosion in the environment of the tube bundle in which it is to be used. Normally, to resist corrosion in both water and other environments, stainless steel will be satisfactory although other metals such as titanium may also be used. Stainless SS 304 is suitable except when chloride corrosion is to be expected when duplex stainless steel will be preferred. The duplex stainless steels which contain various amounts of the alloying elements chromium, nickel and optionally molybdenum are characterized by a mixed microstructure with about equal proportions of ferrite and austenite (hence the common designator "Duplex"). The chemical composition based on high contents of chromium, nickel and molybdenum provides a high level of intergranular and pitting corrosion resistance. Additions of nitrogen promote structural hardening by interstitial solid solution mechanism, which raises the yield strength and ultimate strength values without impairing toughness. Moreover, the two-phase microstructure guarantees higher resistance to pitting and stress corrosion cracking in comparison with conventional stainless steels. They are also notable for high thermal conductivity low coefficient of thermal expansion, good sulfide stress corrosion resistance and higher heat conductivity than austenitic steels as well as good workability and weldability. The duplex stainless steels are a family of grades, which range in corrosion performance depending on their alloy content. Normally, duplex grades such as 2304, 2205 will be adequate for heat exchanger service with the final selection to be made consistent with recognized corrosion resistance requirements. Which ever form of support device is used, the strip may be made up of two or more strips nesting closely against one another if additional thickness or modulus is required. It may become desirable in certain instances, for example, if forming the strips from titanium which resists deep forming operations, to confer the requisite depth on the strip (from the bottom of one saddle to the bottom of the opposing saddle) by forming the saddles slightly less deeply from thinner section strip and then superimposing two strips together to give the desired total thickness or saddle depth. So, in the case of the two-strip variant shown in FIG. 1, there might be four actual strips with two super-imposed strips nesting on top of each other on each side of the final, fully assembled support device. In the case of the single strip modification (FIG. 3), there would be a total of two strips in nesting arrangement superimposed on each other. Support devices made up in this way may have the nesting strips fastened together at ends and possibly in between by means such as welding or riveting.

In the two-strip embodiment, an alternative means to provide an adjustment to the thickness of the support device is to place a shim plate between the two saddle strips and connect it to the two saddle strips by some mechanism as welding or riveting. The thickness of this shim strip can be varied as required to provide the correct dimension to span the channel in a manner to provide the needed support interference.

Insertion of the tube supports into the tube bundle may be facilitated by first inserting a metal bar with beveled edges having a thickness that is slightly greater than the total depth of the support (including the saddles or other raised zones) after which the support is inserted into place and the metal bar is slowly removed to ensure the proper locking in of the tubes and the tube support. The bar may also be used in a similar manner to facilitate removal of the supports. An alternative insertion technique uses an expandable hose which may be pressurized from inside to displace the exchanger tubes outwards while the support device is inserted near the hose. Suitable expandable hoses of this kind may be fabricated from an interior tube of a resilient polymer material such as nylon, rubber or other elastomeric material with a surrounding braided sleeve, e.g., of stainless steel or nylon, for improved regularity of operation and increased safety. The hose, which is preferably flat in its unpressurized state, has a diameter (or a thickness in the case of flat hose) chosen to be just less than the spacing between the exchanger tubes so that it can be inserted readily into a tube lane. The hose has one closed end with the open end being attached to a supply of pressurized fluid, either air, gas or liquid. In one form, the open end can simply have a union or connector enabling the hose to be connected to the fluid source and, later on, deflated or depressurized. In the case of a hose intended to be inflated by air pressure, for example, the connector may be in the form of a Schraeder connector. A pressure regulating valve should be included for safety reasons, to prevent overinflation. Alternatively, a hydraulic pump may be provided to form an integrated unit with its own dedicated pressurization. The hydraulic pump may be activated by hand, in the manner of a hydraulic jack or even by a motor if the additional complexity may be tolerated. Again, a pressure regulator may be provided for safety. In use, the closed end of the hose is slipped into the tube lane into which the support device is to be inserted and expanded by applying pressure to the interior; the hose expands outwards and displaces the tubes a small distance to facilitate the insertion of the support device, after which the pressure may be released to permit the hose to resume its normal diameter or thickness so that it may be withdrawn out of the tube lane, leaving the support device in place, engaged by the tubes on either side of the tube lane. The supports may be inserted at axial locations determined by experience or by vibration studies for the relevant equipment.

With the back-to-back form of construction, the tube-engaging zones can be formed by a single pressing operation in the transverse direction, fabricating several rows of saddles at a time, with successive pressings along the length of the support, in a simple press with a low pressing force. The use of two press rolls would, of course, represent the most economical option for large-scale manufacture but is not necessary and cheaper, simpler equipment could be used failing access to greater resources. The pressings can then be fastened together to form the final support. The unitary, slitted, formed strips will normally be made in two operations, first by punching out the slits and second by forming the saddles using a press with opposed dies. A single operation which will slit the strips, press out the opposing tube-engaging zones and form the saddles is not, however, excluded if suitable equipment is available. One advantage of the present tube supports of either type described above is that they can be formed by a simple pressing operation on a flat metal strip, without the necessity to make three-dimensional pressings. The tube-engaging zones are formed by a simple, lateral forming operation which does not require pressing the saddles into any complicated sections such as V-sections or channels.

What is claimed is:

1. A support device for a plurality of elongated tubes, wherein the plurality of tubes are arranged in rows with spacer lanes separating adjacent rows of tubes, the support device comprising:

an elongated longitudinally extending strip having a pair of opposing faces and a medial plane; and a plurality of tube engaging zones spaced along the strip and extending laterally outward away from the pair of opposing faces to engage tubes on adjacent sides of the spacer lane, wherein the tube engaging zones having outwardly facing tube receiving saddles, wherein each tube engaging zone includes symmetrical first and second tube receiving saddles extending from opposing faces of the strip, wherein a first tube receiving saddle located on one of the opposing faces and a second tube receiving saddle located on another of the opposing faces opposite the first tube receiving saddle, wherein the first tube receiving saddle having a pair of lateral extensions extending outwardly away from the medial plane and an outwardly facing arcuate surface extending between end portions of the pair of lateral extensions, wherein said outwardly facing arcuate surface being sized to contact and receive a portion of the circumference of one tube therein, wherein the second tube receiving saddle having a pair of lateral extensions extending outwardly away from the medial plane and an outwardly facing arcuate surface extending between end portions of the pair of lateral extensions, wherein said outwardly facing arcuate surface being sized to contact and receive a portion of the circumference of another tube therein, wherein the one tube being located on one side of the spacer lane and the another tube being located adjacent the one tube on an opposite side of the spacer lane, wherein the elongated strip having an intermediate section extending between adjacent tube engaging zones, wherein the intermediate section not being in contact with any adjacent elongated tubes.

2. A tube bundle device comprising:

a tube bundle having a plurality of elongated tubes, wherein the plurality of elongated tubes are arranged in rows with tube lanes separating adjacent rows of elongated tubes; and at least one support device, wherein each support device comprising an elongated longitudinally extending strip having a pair of opposing faces and a medial plane, and a plurality of tube engaging zones spaced along the strip and extending laterally outward away from the pair of opposing faces to engage tubes on adjacent sides of the spacer lane, wherein the tube engaging zones having outwardly facing tube receiving saddles, wherein each tube engaging zone includes symmetrical first and second tube receiving saddles extending from opposing faces of the strip, wherein a first tube receiving saddle located on one of the opposing faces and a second tube receiving saddle located on another of the opposing faces opposite the first tube receiving saddle, wherein the first tube receiving saddle having a pair of lateral extensions extending outwardly away from the medial plane and an outwardly facing arcuate surface extending between end portions of the pair of lateral extensions, wherein said outwardly facing arcuate surface being sized to contact and receive a portion of the circumference of one tube therein, wherein the second tube receiving saddle having a pair of lateral extensions extending outwardly away from the medial plane and an outwardly facing arcuate surface extending between end portions of the pair of lateral extensions, wherein said outwardly facing arcuate surface being sized to contact and receive a portion of the circumference of another tube therein, wherein the one tube being located on one side of the spacer lane and the another tube being located adjacent the one tube on an opposite side of the spacer lane, wherein the elongated strip having an intermediate section extending between adjacent tube engaging zones, wherein the intermediate section not being in contact with any adjacent elongated tubes.

3. The tube bundle device according to claim 2 in which the tube bundle is encircled by a girth band, wherein opposing ends of each tube support device are attached thereto.

* * * * *